US006960123B2

(12) United States Patent
Mitarai

(10) Patent No.: US 6,960,123 B2
(45) Date of Patent: Nov. 1, 2005

(54) CLEANING SHEET FOR PROBE NEEDLES

(75) Inventor: Kenji Mitarai, Miyazaki (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 10/968,991

(22) Filed: Oct. 21, 2004

(65) Prior Publication Data

US 2005/0191952 A1 Sep. 1, 2005

(30) Foreign Application Priority Data

Mar. 1, 2004 (JP) ..... 2004/056282

(51) Int. Cl.[7] ..... B24B 19/00
(52) U.S. Cl. ..... 451/314; 451/527; 451/533; 438/14; 15/210.1
(58) Field of Search ..... 451/8, 11, 313, 451/314, 527, 530, 533; 15/208, 210.1; 438/14; 134/6, 2

(56) References Cited

U.S. PATENT DOCUMENTS 6,019,663 A * 2/2000 Angell et al. ..... 451/5
6,056,627 A 5/2000 Mizuta
6,130,104 A * 10/2000 Yamasaka ..... 438/14
6,306,187 B1 * 10/2001 Maeda et al. ..... 51/298
6,741,086 B2 5/2004 Maekawa et al.
2002/0028641 A1 3/2002 Okubo et al.
2003/0027496 A1 * 2/2003 Back et al. ..... 451/36
2004/0182418 A1 * 9/2004 Yoshida et al. ..... 134/2

FOREIGN PATENT DOCUMENTS

JP 11-87438 3/1999
JP 11-238768 8/1999
JP 2003-68810 3/2003

* cited by examiner

*Primary Examiner*—Jacob K. Ackun, Jr.
(74) *Attorney, Agent, or Firm*—Rabin & Berdo, PC

(57) ABSTRACT

A cleaning sheet has a disc-shaped substrate. First and second polishing layers are disposed over the substrate. The first polishing layer has a surface formed in a surface-roughened fashion to polish a tip section of each probe needle and has the function of removing adherents leading to inhibition of electrical conduction, which have been adhered to the tip of the needle in a coating or film form. The second polishing layer is a layer in which a large number of polishing grains are mixed into an elastic member and has the function of sticking the tip of the probe needle into the elastic member to remove foreign substances. The height of the surface of the second polishing layer is set so as to become identical to or slightly higher than that of the surface of the first polishing layer.

5 Claims, 6 Drawing Sheets

CLEANING SHEET FOR PROBE NEEDLES

BACKGROUND OF THE INVENTION

1. Field of the Invention

The present invention relates to a cleaning sheet for probe needles, which is capable of substantially simultaneously polishing and removing both film-like adherents leading to inhibition of contactability of needlepoints of a probe card used to measure and inspect the state of completion of each device on a semiconductor wafer (hereinafter simply called "wafer") and aluminum chips or the like adhered to the entire needlepoints.

2. Description of the Related Art

The following two types are known as cleaning sheets for polishing needlepoints of general probe cards.

The first type of cleaning sheet is a sheet in which polishing grains are contained in a sponge-like substance. The cleaning sheet can be used in a prober or the like in the same manner as a wafer by being attached to the surface of, for example, a used wafer or the like. Needle tips of a probe card attached to the prober or the like are stuck into and spaced away from the cleaning sheet from above and below. Thus, foreign substances (i.e., foreign substances leading to inhibition of electrical contact) adhered to the needle tips and their peripheries are removed.

The second type of cleaning sheet is a sheet fine-meshed in its surface and shaped in a sandpaper fashion. The present cleaning sheet can also be used in a prober or the like in the same manner as a semiconductor wafer by being attached to the surface of, for example, a used wafer or the like. Needle tips of a probe card mounted to the prober or the like are moved up and down so as to be pressed against the cleaning sheet. Since the needle tips of the probe card are inclined toward the cleaning sheet, tip sections of needles are polished while sliding on the surface of the cleaning sheet when the needle tips are pressed against the cleaning sheet, whereby film-shaped foreign substances adhered to the tip sections of the needles are eliminated.

However, the conventional two types of cleaning sheets have the following problems (a) through (c).

(a) The first type of cleaning sheet is made up of the sponge-like substance containing the polishing grains. In contrast, the cleaning sheet performs polishing by repeating such operations as to stick the needle tips from above and below and space them away from above and below. Therefore, there is an effect enough to wipe or clean off pad's chips such as aluminum or the like adhered to the entire needlepoints. Since, however, the pressure for contact between the surface of each needle and the cleaning sheet is small, the ability to polish the film-like inhibitory substance that covers each needle tip is low.

The effect of polishing the tip sections of the needles that need sufficient polishing to ensure contactability is not sufficient because the friction to each polishing grain is low as compared with a side face portion of each needle. Since the needle side face portion is larger than the tip section in friction effect in reverse, the whole needle becomes thin in an alternating succession of polishing. For example, automatic needle alignment based on the recognition of the needlepoints of the prober cannot be recognized because the tip sections of the needles become excessively thin, thus leading to trouble causing an inability to use the needles.

(b) The second type of cleaning sheet has the sandpaper-like surface. The needle tip sections are pressed against the cleaning sheet to polish only the tips of the needles. Therefore, although the effect of polishing the tip sections of the needles is sufficiently obtained, the removal of aluminum chips or the like adhered to the peripheries of the needle tips cannot be expected because the contact portions are limited to the tips of the needles. Since only the tip sections of the needles are polished, the wear of each needle tip proceeds so that the diameter of the needle tip becomes large, thus leading to such trouble that needle traces on measuring pads of the semiconductor wafer increase and the positions of needlepoints are shifted so that the needles are brought into contact with the edge portions of the pads.

(c) As long as the two types of cleaning sheets are used, it is difficult to sufficiently perform the removal of the adherents attached to the whole needle tips and the removal of the film-like adherents applied to the needle tips. Upon their execution, there is a need to alternately exchange the cleaning sheets having their characteristics and carry out two polishing operations. When an attempt is made to normally perform needlepoint polishing by a cleaning sheet for probe needles through the use of an automatic polishing function of a prober without using the number of operator-hours in a probing process, the cleaning sheet that can be set to within a device at a time is limited to one type. Therefore, either one of the two types of cleaning sheets is selected and must be used with being set to the device.

SUMMARY OF THE INVENTION

The present invention aims to solve the problems of the prior art and provide a cleaning sheet for probe needles, which is capable of polishing tip sections of probe needles using a prober and removing aluminum chips or the like adhered to the whole needles.

According to one aspect of the present invention, for achieving the above object, there is provided a cleaning sheet for probe needles, which is used in a prober provided with a stage moved horizontally and vertically relative to holding means for holding a probe card provided with a plurality of probe needles in a protruded form, comprising a substrate detachably fixed onto the stage, a surface-roughened first polishing layer which is provided over the substrate and which causes tips of the probe needles to be pressed thereagainst from a vertical direction and polishes the tips of the probe needles when the tips slide in a horizontal direction, and a second polishing layer provided over the substrate adjacent to the first polishing layer as viewed in the direction of motion of the probe card.

The second polishing layer is a layer which has polishing grains mixed into an elastic member having a thickness greater than that of the first polishing layer and which causes the tips of the probe needles to be stuck into the elastic member when the tips are pressed from the vertical direction, thereby polishing side faces of the tips of the probe needles by means of the polishing grains.

According to the invention, the surface-roughened first polishing layer for effectively polishing film-like foreign substances adhered to needle tip portions brought into contact with pads, and the second polishing layer made up of the elastic member containing the polishing grains for removing adherents attached to the entire needlepoints are provided in one cleaning sheet. Therefore, when, for example, needlepoint polishing is executed using an automatic polishing function of a prober while breaking in the course of probing, the tip sections of the needlepoints brought into contact with the pads are effectively polished and thereafter aluminum chips or the like adhered to the whole needlepoints can be eliminated. Thus, it is possible to automatically execute effective needle tip polishing at a time.

According to the invention, the first polishing layer and the second polishing layer are alternately disposed at predetermined intervals. Therefore, when, for example, needlepoint polishing is executed using the automatic polishing function of the prober while breaking in the course of probing, the adherents such as the aluminum chips adhered to the whole needlepoints can be removed substantially simultaneously with the effective polishing of the tip sections of the needlepoints. Particularly since another number of needlepoints of a plurality of needlepoints are subjected to overall polishing at a short traveling range of the probe needles while a certain number of needlepoints of the plurality of needlepoints are being subjected to tip polishing, a polishing processing time interval can greatly be shortened.

The above and further objects and novel features of the invention will more fully appear from the following detailed description appended claims and the accompanying drawings.

DETAILED DESCRIPTION OF THE PREFERRED EMBODIMENTS

Preferred embodiments of the present invention will be explained hereinafter in detail with reference to the accompanying drawings.

A cleaning sheet for probe needles, according to the present invention has a substrate such as a wafer fixed onto a stage of a prober. A first polishing layer and a second polishing layer each shaped in the form of a roughened surface like a sandpaper shape or the like are provided over the substrate. The tip of each of probe needles is pressed against the surface-roughened first polishing layer from the vertical direction and polished when it slides in the horizontal direction. The second polishing layer is provided over the substrate so as to adjoin the first polishing layer as viewed in the direction in which a probe card moves. The second polishing layer is formed by mixing polishing grains into an elastic member having a thickness greater than or equal to that of the first polishing layer. When the tip of the probe needle is pressed from the vertical direction, it is stuck into the elastic member and the side face of the tip of the probe needle is polished by the polishing grains.

For instance, the first polishing layer and the second polishing layer are two-divided into concentric circles or the like and adhered onto the substrate. Alternatively, the first polishing layer and the second polishing layer are alternately and disposed on the concentric circles with a predetermined interval defined therebetween and adhered onto the substrate.

First Preferred Embodiment (Configuration)

Figure 1A:
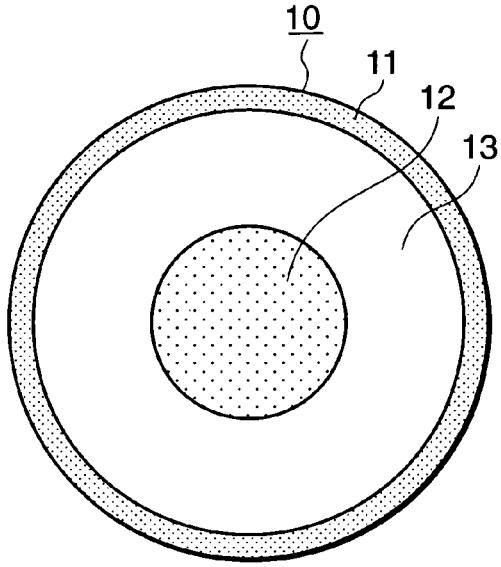
FIG. 1 is a configurational view of a cleaning sheet for probe needles, showing a first embodiment of the present invention.
Figure 1B:
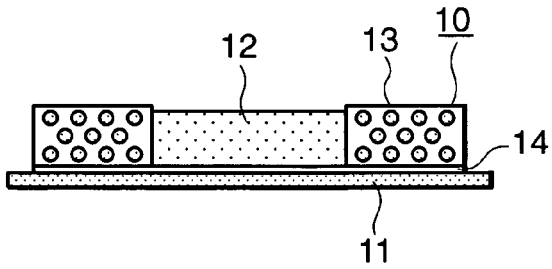
Figure 1C:
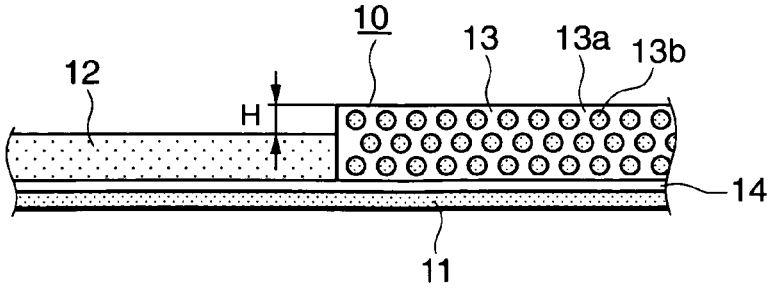

FIGS. 1(A) through 1(C) are configurational views of a cleaning sheet for probe needles, showing a first embodiment of the present invention. FIG. 1(A) is a surface view thereof as seen from above, FIG. 1(B) is a vertical cross-sectional view thereof, and FIG. 1(C) is a partly vertical-sectional enlarged view thereof, respectively.

The cleaning sheet 10 has a disc-shaped substrate 11 such as a wafer. A circular first polishing layer 12 is disposed in a central portion thereof on the substrate 11. A second polishing layer 13 is disposed on a concentric circle at its peripheral portion. These first and second polishing layers 12 and 13 are bonded onto the substrate 11 with an adhesive 14. The first polishing layer 12 has a surface formed in a surface-roughened fashion (e.g., a sandpaper fashion) to polish a tip section of each probe needle and has the function of principally removing adherents leading to inhibition of electrical conduction, which have been adhered to the tip of the needle in a coating or film form. The second polishing layer 13 is a layer in which a large number of polishing grains 13*b* are mixed into an elastic member (e.g., a sponge-like elastic member) 13*a* and has the function (e.g., the function of wiping or cleaning off aluminum chips or cuttings adhered to the whole needlepoint) of sticking the tip of the probe needle into the elastic member to remove foreign substances.

The height of the surface of the second polishing layer 13 is set so as to become identical to or higher than that of the surface of the first polishing layer 12 slightly (by a step H of about 100 $\mu$m, for example). This results from the following. That is, the needlepoint of the probe needle is polished in the form to slide on the sandpaper-like surface in the central polishing layer 12, whereas in the peripheral polishing layer 13, the needlepoint of the probe needle is polished over its end entirety in the form of being stuck into the sponge-like elastic member 13*a* containing the polishing grains 13*b*. Therefore, there is a fear that when the surface of the peripheral polishing layer 13 becomes lower than that of the central polishing layer 12, the needlepoint does not reach the elastic member 13*a* so that its polishing is not done.

(Cleaning Method)

Figure 2A:
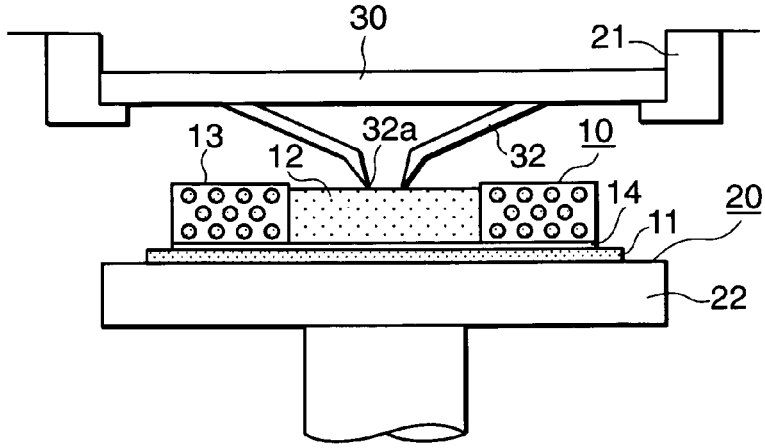
FIG. 2 is a view illustrating a probe needle cleaning method using the cleaning sheet shown in FIG. 1.
Figure 2B:
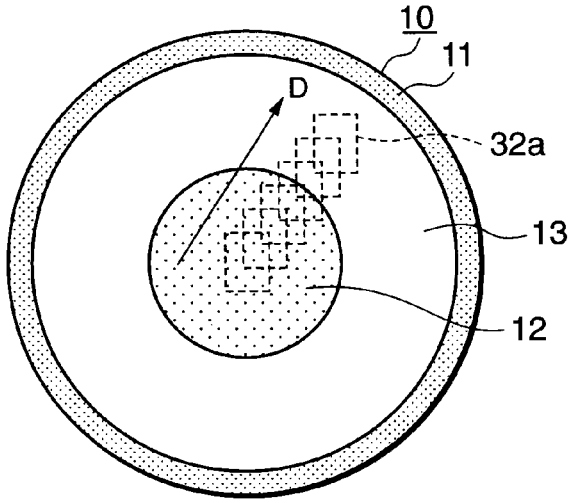
Figure 2C:
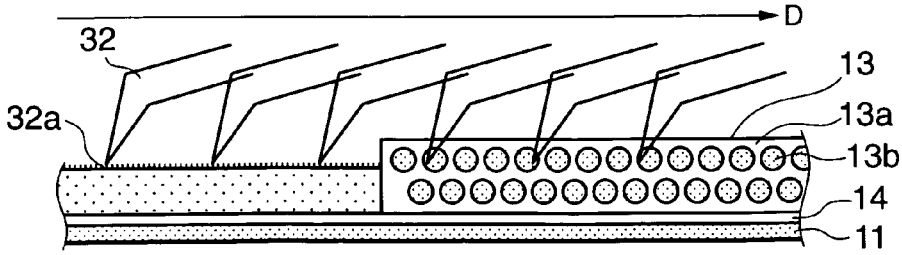

FIGS. 2(A) through 2(C) are views showing one example of a probe needle cleaning method using the cleaning sheet shown in FIG. 1. FIG. 2(A) is a schematic front view of a prober to which the cleaning sheet is mounted, FIG. 2(B) is a surface view of the cleaning sheet, and FIG. 2(C) is a partly vertical-sectional enlarged view of the cleaning sheet.

As shown in FIG. 2(A), the prober 20 for testing a wafer includes holding means (e.g., a holding device) 21 for holding a probe card 30, and a wafer fixing stage 22. Either one of these holding device 21 and stage 22 moves in the horizontal and vertical directions by an unillustrated control device. The probe card 30 held by the holding device 21 has a doughnut plate-like card body 31 having, for example, an opening defined in its central portion. A large number of probe needles 32 are fixed aslant in the center direction at the peripheral edge of the opening. The large number of probe needles 32 are cantilever type metal needles, for example.

The needlepoints 32*a* of these probe needles 32 are disposed in rectangular form in association with pad layouts on the wafer.

In a wafer test process (i.e., probing process) for testing using the prober 20 whether or not each individual semiconductor chip on the wafer is defective, a wafer to be tested is moved to above the stage 22 by a conveying device and adsorbed and fixed onto the stage 22. Then, the probe needles 32 of the probe card 30 held by the holding device 21 come into contact with predetermined pads (electrodes) on the corresponding semiconductor chip of the wafer, and predetermined pressure (needle pressure) is applied thereto (i.e., they are overdriven). After the contact resistance to each pad has been reduced, an electric characteristic test on each individual semiconductor chip is done using a tester connected to the probe needles 32.

When the probe needles 32 are polished using an automatic polishing function of the prober 20, the cleaning sheet 10 is moved to above the stage 20 by the conveying device and thereafter adsorbed and fixed onto the stage 22.

As shown in FIG. 2(B), either the holding device 21 or the stage 22 is moved in the horizontal direction and the needlepoints 32*a* of the lots of probe needles 32 are moved to the central portion of the cleaning sheet 10. Subsequently, either the holding device 21 or the stage 22 is moved in the vertical direction, so that the large number of needlepoints 32*a* are brought into contact with the sandpaper-like polishing layer 12 at the central portion of the cleaning sheet 10. Next, the large number of needlepoints 32*a* are overdriven in the vertical direction so that they are pressed against the surface of the polishing layer 12. Since the needlepoints 32*a* are inclined to the sandpaper-like polishing layer 12, the needlepoints 32*a* are polished in the form to slide along the polishing layer 12 when these needlepoints 32*a* are pressed against the polishing layer 12. Such polishing is done once or plural times in such a peripheral direction D shown in FIG. 2(B), so that film-shaped foreign substances leading to inhibition of electrical contactability of the needlepoints 32*a* are removed.

Next, as shown in FIG. 2(C), either the holding device 21 or the stage 22 is moved in the horizontal direction and the large number of needlepoints 32*a* are gradually moved in the peripheral direction D to reach the sponge-like polishing layer 13. Subsequently, either the holding device 21 or the stage 22 is moved in the vertical direction so that the large number of needlepoints 32*a* are brought into contact with the polishing layer 13. Then, the needlepoints 32*a* are overdriven in the vertical direction so that the large number of needlepoints 32*a* are stuck into the surface of the polishing layer 13 by being pressed against the surface of the polishing layer 13, after which they are spaced away from the polishing layer 13. When the needlepoints 32*a* stick into the polishing layer 13 and are spaced away therefrom, the whole needlepoints are polished by their corresponding polishing grains 13*b* lying in the polishing layer 13. Such polishing is done once or plural times in such peripheral directions as shown in FIGS. 2(B) and 2(C), so that adherents such as aluminum chips, of the whole needlepoints are eliminated.

Thus, when the automatic polishing function of the prober 20 is used, the needlepoints 32*a* of the probe needles 32 are moved from the polishing layer 12 at the central portion of the cleaning sheet 10 to the polishing layer 13 at its peripheral portion, so that the portions to be polished of the probe needles 32 are changed from the tip sections of the needlepoints 32*a* to the whole needlepoints. In the cleaning sheet 10, a step H ranging from approximately 0 to 100 $\mu$m is provided between the height of the surface of the sandpaper-like polishing layer 12 at its central portion and the height of the surface of the sponge-like polishing layer 13 at its peripheral portion so that the surface of the sponge-like polishing layer 13 is set so as become higher than that of the polishing layer 12. Therefore, if overdrive is set in such a way that the height of each probe needle 32 is adjusted in matching with the height used in the polishing layer 13 at the central portion of the cleaning sheet 10, then the needlepoints 32*a* are stuck into the sponge-like elastic member 13*a* containing the polishing grains 13*b* at its peripheral portion, whereby adherents attached to the whole needlepoints are removed.

(Effects)

The first embodiment brings about the following effects (1) and (2).

(1) A problem arises in the prior art in that when an attempt is made to clean the whole needlepoints by means of the cleaning sheet for the needle tips, a polishing effect enough to sufficiently remove the film-shaped adherents of the needle tips is not obtained, whereas if the cleaning sheet for polishing the needle tips alone s used, then the foreign substances attached to the whole needlepoints cannot be removed sufficiently. Either one of the two types of cleaning sheets was selectively used to utilize the automatic polishing function of the prober. That is, there was a need to use either one of the cleaning sheets and thereafter replace the used cleaning sheet with another cleaning sheet by manual work, and execute polishing work twice.

In the first embodiment in contrast, in order to obtain the two polishing effects simultaneously, the two types of cleaning sheets are utilized in combination and the sandpaper-like polishing layer 12 for effectively polishing the film-shaped foreign substances adhered to the needle tip portions brought into contact with the pads and the sponge-like polishing layer 13 containing the polishing grains 13*b* for removing the adherents attached to the whole needlepoints are provided in one cleaning sheet 10. Therefore, when needlepoint polishing is executed using the automatic polishing function of the prober 20 while breaking in the course of probing, the tip sections of the needlepoints 32*a* brought into contact with the pads are effectively polished and thereafter the aluminum chips or the like adhered to the whole needlepoints can be eliminated. Thus, it is possible to automatically execute effective needle tip polishing at a time.

(2) As an alternative to the structure shown in FIG. 1, it may be feasible to dispose the sponge-like polishing layer 13 in the central portion on the substrate 11 and dispose the sandpaper-like polishing layer 12 in the peripheral portion thereof, and pressing the probe needles 32 while being moved from the central portion to the peripheral portion or vice versa to thereby polish them. Thus, the operation and effect substantially similar to the above (1) are obtained.

Second Preferred Embodiment (Configuration)

Figure 3A:
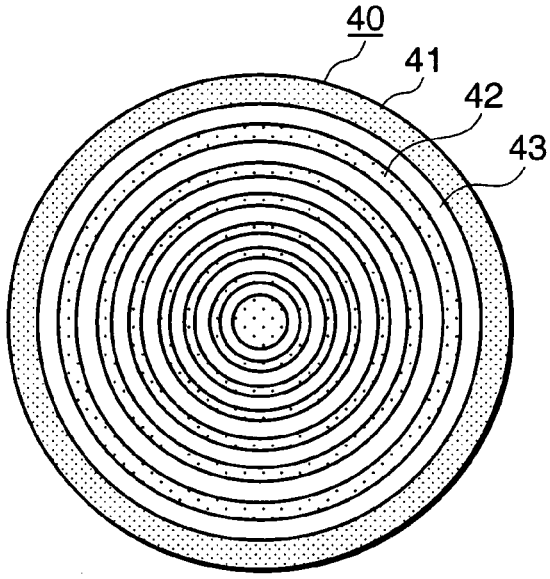
FIG. 3 is a configurational view of a cleaning sheet for probe needless, showing a second embodiment of the present invention.
Figure 3B:
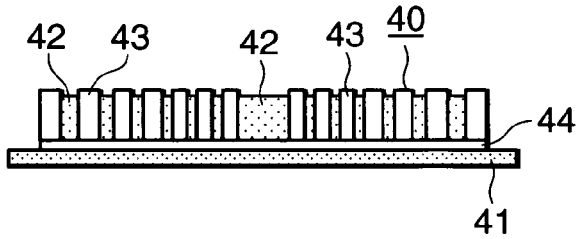
Figure 3C:
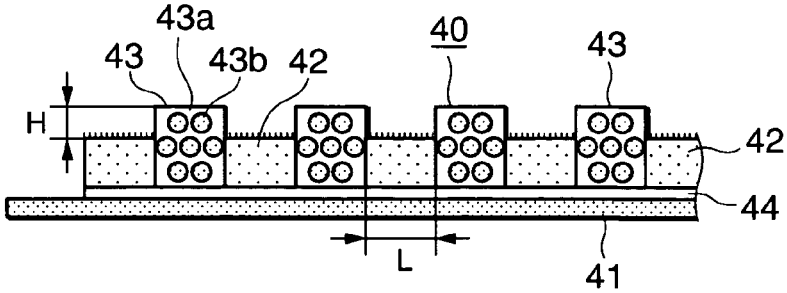

FIGS. 3(A) through 3(C) are configurational views of a cleaning sheet for probe needles, showing a second embodiment of the present invention. FIG. 3(A) is a surface view thereof as viewed from above, FIG. 3(B) is a vertical cross-sectional view thereof, and FIG. 3(C) is a partly vertical-sectional enlarged view thereof, respectively.

It is considered that since the area for polishing the tip sections of the probe needles 32 and the area for polishing the whole needlepoints are largely divided into the two like the polishing layer 12 at the central portion of the round sheet and the polishing layer 13 at its peripheral portion in the cleaning sheet 10 according to the first embodiment, the distance over which the probe needles 32 move on the cleaning sheet 10, increases upon executing the polishing and the processing time becomes long. Therefore, the present embodiment is set to a structure having two functions for alternately disposing, at intervals of width D, first polishing layers 42 for polishing needle tip sections and second polishing layers 43 for polishing the whole needlepoints on their corresponding concentric circles in order to minimize the moving distance of each probe needle 32 upon execution of the polishing and shorten the processing time.

That is, in the cleaning sheet 40 for the probe needles, showing the present embodiment, the first polishing layers 42 and the second polishing layers 43 are concentrically alternately disposed at intervals of width D (e.g., distances ranging from approximately a few 100 $\mu$m to 1 mm) over a disc-shaped substrate 41 such as a wafer. These first and second polishing layers 42 and 43 are adhered onto the substrate 41 with an adhesive 44. In a manner similar to the first embodiment, each of the first polishing layers 42 has a surface formed in a surface-roughened fashion (e.g., a sandpaper fashion) to polish a tip section of each probe needle 32 and has the function of principally removing adherents leading to inhibition of electrical conduction, which have been adhered to the tip of the needle in a coating or film form. Each of the second polishing layers 43 is a layer in which a large number of polishing grains 43*b* are mixed into an elastic member (e.g., a sponge-like elastic member) 43*a* and has the function (e.g., the function of wiping or cleaning off aluminum chips or cuttings adhered to the whole needlepoints) of sticking the tip of the probe needle 32 into the elastic member to remove foreign substances.

In a manner similar to the first embodiment, the height of the surface of the second polishing layer 43 is set so as to become identical to or higher than that of the surface of the first polishing layer 42 slightly (by a step H of about 100 $\mu$m, for example).

(Cleaning Method)

Figure 4A:
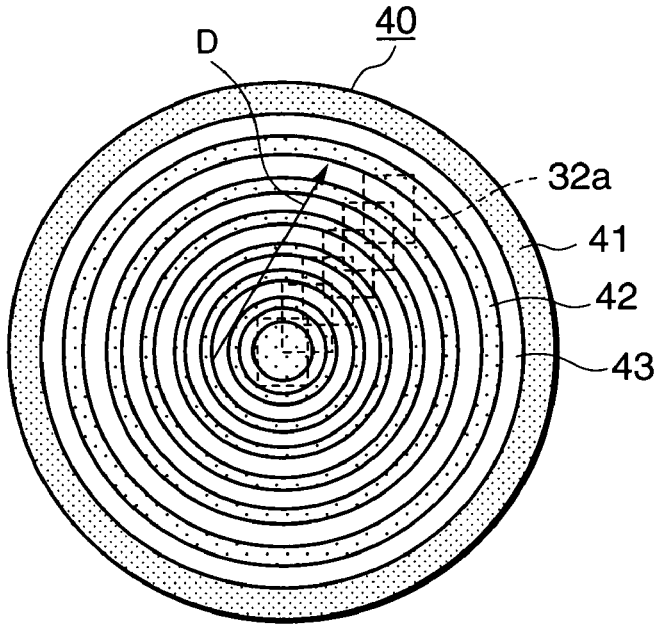
FIG. 4 is a view showing a probe needle cleaning method using the cleaning sheet shown in FIG. 3.
Figure 4B:
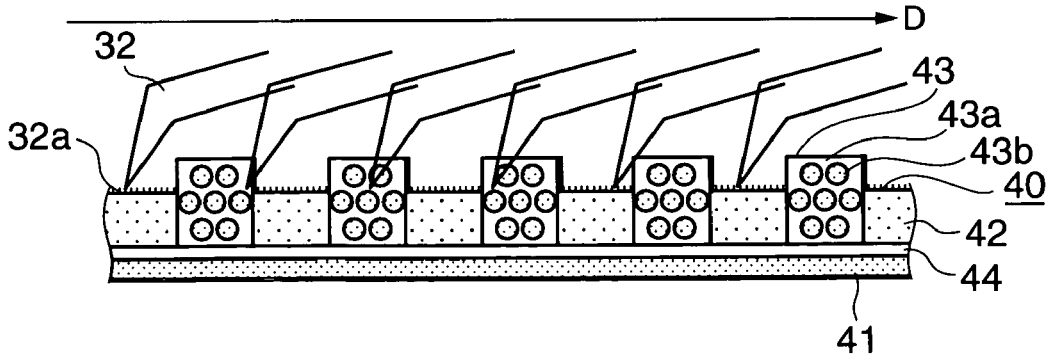

FIGS. 4(A) and 4(B) are views showing one example of a probe needle cleaning method using the cleaning sheet shown in FIG. 1. FIG. 4(A) is a surface view of the cleaning sheet attached to a prober, and FIG. 4(B) is a partly vertical-sectional enlarged view of the cleaning sheet.

When the probe needles 32 are polished using the automatic polishing function of the prober 20 shown in FIG. 2(A), for example, the cleaning sheet 40 is moved to above the stage 22 by the conveying device and adsorbed and fixed onto the stage 22. As shown in FIGS. 4(A) and 4(B), either the holding device 21 or the stage 22 is moved in the horizontal direction and the needlepoints 32*a* of the large number of probe needles 32 are moved to the central portion of the cleaning sheet 40. Subsequently, either the holding device 21 or the stage 22 is moved in the vertical direction and thereby the large number of needlepoints 32*a* are pressed against the surfaces of the sandpaper-like polishing layers 42 at the central portion of the cleaning sheet 40, so that the film-shaped adherents of the needle tip sections are polished.

Next, when either the holding device 21 or the stage 22 is moved in the horizontal direction by a width L, the large number of needlepoints 32*a* are moved in a peripheral direction D by the width L so that they reach the sponge-like polishing layers 43 disposed adjacent to each other nearby. Subsequently, either the holding device 21 or the stage 22 is moved in the vertical direction and the large number of needlepoints 32*a* are stuck into the surfaces of the polishing layers 43 by being pressed against the surfaces thereof, after which they are spaced away from the polishing layers 43. Thus, the whole needlepoints are polished by the polishing grains 43*b* lying in the polishing layers 43 so that adherents such as the aluminum chips attached to the whole needlepoints are eliminated.

Thus, the probe needles 32 are pressed against the cleaning sheet 40 plural times while being moved at short intervals of width L in the peripheral direction D from the central portion of the cleaning sheet 40. It is, therefore, possible to perform tip polishing and overall polishing of each needlepoint 32*a* in a shorter time by virtue of the movement of each probe needle 32 over a short range. That is, the motion of the probe needle 32 is minimized and the tip polishing and overall polishing of the needlepoints 32*a* can be executed substantially simultaneously.

(Effects or the Like)

The present embodiment brings about the following effects (1) and (2).

(1) The cleaning sheet 40 according to the present embodiment has a structure wherein the sandpaper-like polishing layers 42 for effectively polishing the tips of the needlepoints 32*a* of the probe needles 32, and the sponge-like polishing layers 43 containing the polishing grains 43*b* for removing the adherents with the whole needlepoints as objects are alternately combined together at short intervals of width L (distances ranging from approximately a few 100 $\mu$m to 1 mm, for example). Therefore, when needlepoint polishing is executed using the automatic polishing function of the prober 30 while breaking in the course of probing, the adherents such as the aluminum chips adhered to the whole needlepoints can be removed substantially simultaneously with the effective polishing of the tip sections of the needlepoints 32*a*. Since the first polishing layers 42 and the second polishing layers 43 are alternately disposed at short range in the present embodiment in particular, another number of needlepoints 32*a* of the plurality of needlepoints 32*a* are subjected to overall polishing at a short traveling range of the probe needles 32 while a certain number of needlepoints 32*a* of the plurality of needlepoints 32*a* are being subjected to tip polishing. It is, therefore, possible to greatly shorten a polishing processing time.

(2) The operation and effect substantially similar to the above (1) are obtained even when the layout positions of the first polishing layers 42 and the layout positions of the second polishing layers 43 are alternately interchanged or the direction to move the needlepoints 32*a* is changed from the peripheral portion to the central portion in FIG. 4, as an alternative to the structure shown in FIG. 3.

Third Preferred Embodiment

Figure 5:
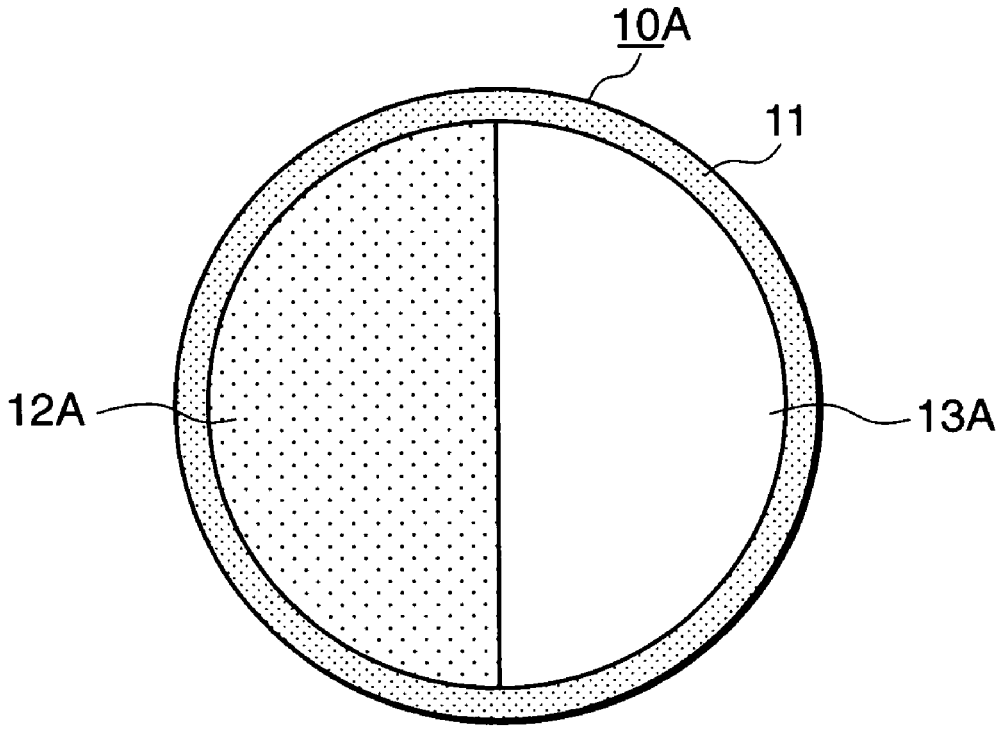
FIG. 5 is a surface view of a cleaning sheet for probe needles, showing a third embodiment of the present invention.

FIG. 5 is a surface view of a cleaning sheet for probe needles showing a third embodiment of the present invention, as viewed from thereabove.

The present cleaning sheet 10A is a modification of the first embodiment. A semicircular first polishing layer 12A and a semicircular second polishing layer 13A both divided into two are disposed over a disc-shaped substrate 11. These first and second polishing layers 12A and 13A are adhered onto the substrate 11. The first polishing layer 12A has a sandpaper-like surface and polishes the tips of the needlepoints 32*a*. The second polishing layer 13A is a sponge-like layer containing polishing grains and polishes the whole needlepoints with the needlepoints 32*a* being stuck therein.

In a polishing process using the prober 20, the probe needles 32 are moved from the first polishing layer 12A to the second polishing layer 13A and pressed against the second polishing layer 13A. Alternatively, the probe needles 32 are moved from the second polishing layer 13A to the first polishing layer 12A and pressed against the first polishing layer 12A. Therefore, the operation and effect substantially similar to the first embodiment are obtained.

Fourth Preferred Embodiment

Figure 6:
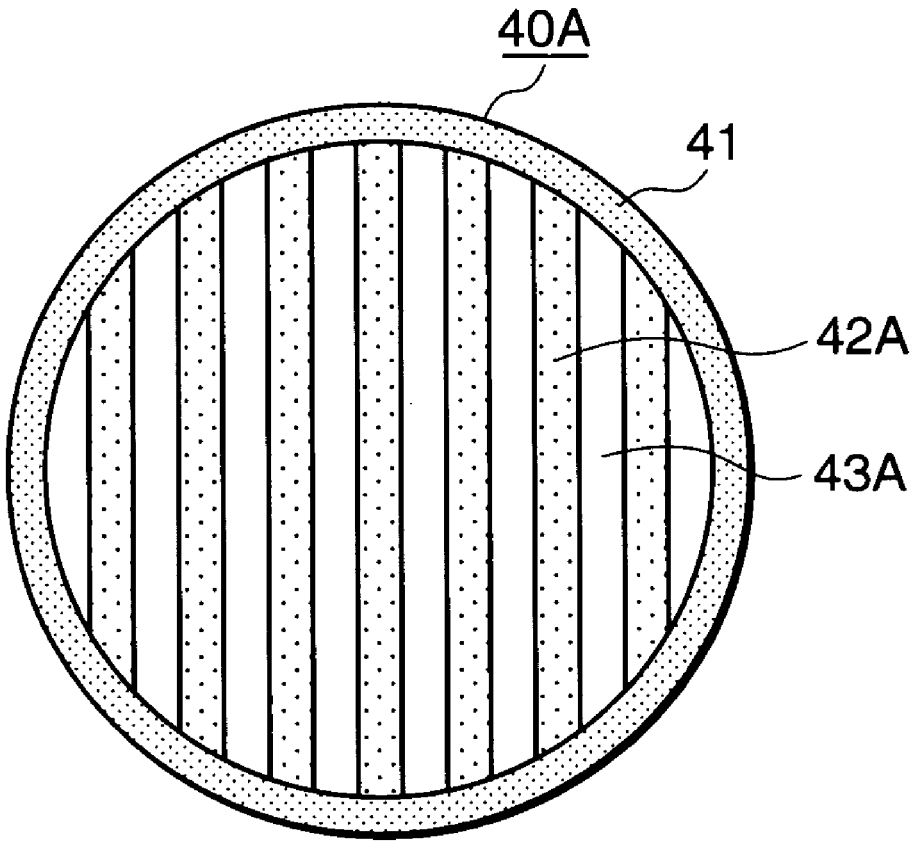
FIG. 6 is a surface view of a cleaning sheet for probe needles, illustrating a fourth embodiment of the present invention.

FIG. 6 is a surface view of a cleaning sheet for probe needles showing a fourth embodiment of the present invention, as viewed from thereabove.

The present cleaning sheet 40A is a modification of the second embodiment. Band-like first polishing layers 42A and band-like second polishing layers 43A are alternately disposed over a disc-shaped substrate 41 at small intervals of width L. These first and second polishing layers 42A and 43A are adhered onto the substrate 41. Each of the first polishing layers 42A has a sandpaper-like surface and polishes the tips of the needlepoints 32*a*. Each of the second polishing layers 43A is a sponge-like layer containing polishing grains and polishes the whole needlepoints with the needlepoints 32*a* being stuck therein.

In a polishing process using the prober 20, the probe needles 32 are moved from the central portion of the cleaning sheet 40 to the peripheral portion thereof and pressed against it. Alternatively, the probe needles 32 are moved from the peripheral portion to the central portion and pressed against it. Therefore, the operation and effect substantially similar to the second embodiment are obtained.

Fifth Preferred Embodiment

The present invention is not limited to the first through fourth embodiments but can take various modifications. As the fifth embodiment showing the modification, the following (a) and (b), for example, are brought about.

(a) The substrates 11 and 41 on which the polishing layers 12, 12A, 13, 13A, 42, 42A, 43 and 43A are disposed, may be formed of other shapes such as a square other than the round shape and other materials. At this time, the shape and material of each of the polishing layers 12, . . . may be changed according to the shape and material or the like of each of the substrates 11 and 41. Particularly when the shapes of the substrate and polishing layers are changed, motion control in the horizontal direction, of the automatic polishing function of the prober 20 may be changed according to the change in shape.

(b) Although the two types of polishing layers of the first polishing layers 12, 42, . . . and the second polishing layers 13, 43, . . . are disposed over the substrates 11 and 41 in combination in the first through fourth embodiments respectively, for example, ones having coarse-meshed surfaces, of the first polishing layers 12, 42, . . . and ones having fine-meshed surfaces, of the first polishing layers 12, 42, . . . may be utilized in combination, or ones containing polishing grains large in diameter, of the second polishing layers 13, 43, . . . and ones containing polishing grains small in diameter, of the second polishing layers 13, 43, . . . may be utilized in combination. That is, even if the polishing layers of three types or more are combined together and placed over the substrates 11 and 41 respectively, the operation and effect substantially similar to the above embodiment are obtained.

While the preferred form of the present invention has been described, it is to be understood that modifications will be apparent to those skilled in the art without departing from the spirit of the invention. The scope of the invention is to be determined solely by the following claims.

What is claimed is:

1. A cleaning sheet for probe needles, comprising:

a substrate detachably fixed onto a stage moved horizontally and vertically relative to holding means for holding a probe card provided with a plurality of probe needles in a protruded form;

a surface-roughened first polishing layer provided over the substrate, said first polishing layer causing tips of the probe needles to be pressed thereagainst from a vertical direction and polishing the tips of the probe needles when the tips slide in a horizontal direction; and a second polishing layer provided over the substrate adjacent to the first polishing layer as viewed in the direction of motion of the probe card, said second polishing layer having polishing grains mixed into an elastic member having a thickness greater than that of the first polishing layer and causing the tips of the probe needles to be stuck into the elastic member when the tips are pressed from the vertical direction, thereby polishing side faces of the tips of the probe needles by means of the polishing grains.

2. The cleaning sheet according to claim 1, wherein the first polishing layer and the second polishing layer are divided into two and provided over the substrate.

3. The cleaning sheet according to claim 2, wherein the first polishing layer and the second polishing layer are divided into two on concentric circles and adhered onto the substrate.

4. The cleaning sheet according to claim 1, wherein the first polishing layer and the second polishing layer are alternately disposed at predetermined intervals and provided over the substrate.

5. The cleaning sheet according to claim 4, wherein the first polishing layer and the second polishing layer are alternately disposed on concentric circles at predetermined intervals.

* * * * *